US006784725B1

(12) United States Patent
Wadhwa et al.

(10) Patent No.: US 6,784,725 B1
(45) Date of Patent: Aug. 31, 2004

(54) SWITCHED CAPACITOR CURRENT REFERENCE CIRCUIT

(75) Inventors: Sanjay Kumar Wadhwa, Gurgaon (IN); Qadeer Ahmad Khan, New Delhi (IN); Kulbhushan Misri, Gurgaon (IN)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

(21) Appl. No.: 10/418,338

(22) Filed: Apr. 18, 2003

(51) Int. Cl.[7] ..... G05F 1/10; G05F 3/02
(52) U.S. Cl. ..... 327/543; 327/337
(58) Field of Search ..... 327/337, 538–541, 327/543; 323/313, 315, 316

(56) References Cited

U.S. PATENT DOCUMENTS 4,374,357 A 2/1983 Olesin et al.
4,978,868 A * 12/1990 Giordano et al. ..... 327/539
5,408,174 A 4/1995 Leonowich
6,191,637 B1 * 2/2001 Lewicki et al. ..... 327/337
6,577,302 B2 * 6/2003 Hunter et al. ..... 345/204

OTHER PUBLICATIONS

Ogey, H. and Aebischer, D., CMOS Current Reference Without Resistance, IEEE J. Solid–State Circuits, vol. 32, No. 7, pp 1132–1135, Jul. 1997.
Torelli, G. and de la Plaza, M., Tracking Switched–Capacitor CMOS Current Reference, IEE Proc. Circuit Devices Systems, vol. 145, No. 1, pp. 44–47, Feb. 1998.
Malik, S.Q., Schlarmann, M.E., and Geiger, R.L. A Low Temperature Sensitivity Switched–Capacitor Current Reference, European Conference on Circuit Theory and Design, Espoo, Finland, Aug. 28–31, 2001.

* cited by examiner

*Primary Examiner*—Quan Tra
(74) *Attorney, Agent, or Firm*—Charles E. Bergere

(57) ABSTRACT

A switched capacitor current reference circuit generates an almost constant reference current across the parameters of process, voltage and temperature. A reference voltage is generated within the circuit, which eliminates the need for an external reference voltage. The reference current is generated by applying the reference voltage across a resistor emulated with a pair of switched capacitor circuits.

17 Claims, 3 Drawing Sheets

SWITCHED CAPACITOR CURRENT REFERENCE CIRCUIT

BACKGROUND OF THE INVENTION

The present invention relates generally to a current reference circuit, and more particularly, to a switched capacitor current reference circuit with low dependence on process, voltage and temperature.

A current reference circuit used to bias various circuit modules such as op-amps, comparators, data converter bias circuits, and phase-lock loops is an important building block in analog and mixed-signal integrated circuits. Such circuit modules require a precise current reference with low dependence on Process, Voltage, and Temperature (PVT). One method of generating a precise current reference is with a voltage to current converter circuit in which either a stable external reference voltage or a band-gap reference voltage is applied across an external resistor. This method requires that the value of the external resistor must remain almost constant under different operating conditions. Integrated resistors have a large spread across PVT and consume a large silicon area and therefore, are less than ideal for generating a precise current reference. Using an off-chip voltage reference and external resistor for a current reference generator increases the chip pin count and the number of board components. The use of an on-chip band-gap reference circuit also requires a separate V to I converter with an external resistor, and requires the use of at least two op-amps, one for a band-gap circuit and another for V to I conversion.

Accordingly, it would be advantageous to have a current reference circuit for generating a substantially constant current independent of PVT, and which circuit may be formed on an integrated circuit.

BRIEF DESCRIPTION OF THE DRAWINGS

The following detailed description of a preferred embodiment of the invention will be better understood when read in conjunction with the appended drawings. For the purpose of illustrating the invention, there is shown in the drawings an embodiment that is presently preferred. It should be understood, however, that the invention is not limited to the precise arrangement and instrumentalities shown. In the drawings.

DETAILED DESCRIPTION OF PREFERRED EMBODIMENTS

Figure 1:
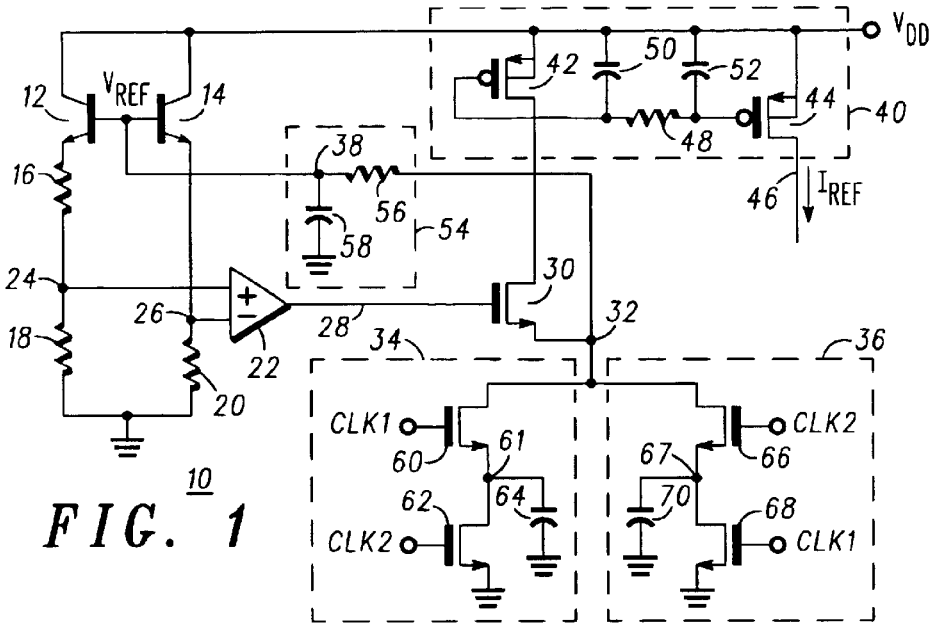
FIG. 1 is a schematic diagram of a preferred embodiment of a current reference circuit in accordance with the present invention.

The detailed description set forth below in connection with the appended drawings is intended as a description of the presently preferred embodiment of the invention, and is not intended to represent the only form in which the present invention may be practiced. It is to be understood that the same or equivalent functions may be accomplished by different embodiments that are intended to be encompassed within the spirit and scope of the invention. In the drawings, like numerals are used to indicate like elements throughout.

In one embodiment, the present invention provides a switched capacitor current reference circuit for generating a substantially constant reference current including a first transistor having a collector connected to a first voltage and an emitter connected to a second voltage by way of first and second series connected resistors, and a second transistor having a collector connected to the first voltage, an emitter connected to the second voltage by way of a third resistor, and a base connected to a base of the first transistor. An op amp has a positive input terminal connected to a node between the first and second resistors, a negative input terminal connected to a node between the emitter of the second transistor and the third resistor, and an output terminal. A third transistor has a first terminal connected to the output terminal of the op amp and a second terminal connected to a first node. A first switched capacitor circuit is connected between the first node and the second voltage. A second switched capacitor circuit is connected between the first node and the second voltage, and in parallel with the first switched capacitor circuit. A feedback path connects the first node to a second node between the bases of the first and second transistors. The reference current is provided at a third terminal of the third transistor.

Referring now to FIG. 1, a schematic diagram illustrating a preferred embodiment of a current reference circuit 10 in accordance with the present invention is shown. In the current reference circuit 10, a band-gap reference circuit and a voltage to current converter circuit have been integrated in such a way that the circuit 10 has only a single op-amp. Thus, as compared with prior art circuits, the present invention eliminates the use of a separate voltage to current converter, which reduces the silicon area and power consumption of the circuit 10. Further, no external reference voltage is required. Rather than using an external resistor, two parallel, integrated switched capacitor (SC) resistors are used to form a fully integrated current reference. By virtue of a low spread in the value of the integrated capacitors across PVT, as compared to integrated resistors, the generated reference current remains substantially constant.

The current reference circuit 10 has a first transistor 12 having a collector connected to a first voltage VDD and an emitter connected to a second voltage VSS by way of first and second series connected resistors 16 and 18. A second transistor 14 has a collector connected to the first voltage VDD, an emitter connected to the second voltage VSS by way of a third resistor 20, and a base connected to a base of the first transistor 12. In one embodiment of the invention, the first and second transistors 12 and 14 are bipolar transistors. In another embodiment, the first and second transistors comprise sub-threshold NMOS transistors. The first voltage VDD comprises a predetermined supply voltage and the second voltage VSS has a ground potential.

An op amp 22 has a positive input terminal connected to a node 24 between the first and second resistors 16 and 18, a negative input terminal connected to a node 26 between the emitter of the second transistor 14 and the third resistor 20, and an output terminal 28. A third transistor 30 has a first terminal connected to the output terminal 28 of the op amp 22 and a second terminal connected to a first node 32. A first switched capacitor circuit 34 is connected between the first node 32 and the second voltage VSS. A second switched capacitor circuit 36 is connected between the first node 32 and the second voltage VSS, and in parallel with the first switched capacitor circuit 34. A feedback path connects the first node 32 to a second node 38 between the bases of the first and second transistors 12 and 14. The reference current is provided at a third terminal of the third transistor 30 and a band gap reference voltage (VREF) is provided at the first node 32.

The current reference circuit 10 includes a fourth transistor 42 having a first terminal connected to the third terminal of the third transistor 30, a second terminal connected to the first voltage VDD, and a third terminal or gate connected to its first terminal. A fifth transistor 44 has a first terminal 46 that provides the reference current, a second terminal connected to the first voltage VDD, and a third terminal or gate connected to the first terminal of the fourth transistor 42 by way of a fifth resistor 48. In the presently preferred embodiment, a first low pass filter 40 is provided for reducing a ripple in the reference current. The first low pass filter 40 includes a first capacitor 50 connected between the first voltage VDD and the first terminal of the fourth transistor 42 and a second capacitor 52 is connected between the first voltage VDD and the third terminal of the fifth transistor 44.

In the presently preferred embodiment, the current reference circuit 10 also includes a second low pass filter 54 for reducing spikes at the second node 38. The second low pass filter 54 comprises a fourth resistor 56 connected between the first and second nodes 32 and 38 and a third capacitor 58 connected between the second node 38 and the second voltage VSS.

In the presently preferred embodiment, the first and second switched capacitor circuits 34 and 36 have the same structure and are connected in parallel between the first node 32 and the second voltage VSS. More particularly, the first switched capacitor circuit 34 comprises a first switch 60 having a drain connected to the first node 32, a source connected to a third node 61, and a gate connected to a first clock terminal that receives a first clock signal CLK1. A second switch 62 has a drain connected to the third node 61, a source connected to the second voltage VSS, and a gate connected to a second clock terminal that receives a second clock signal CLK2. That is, the first and second switches 60 and 62 are connected in series between the first node 32 and the second voltage VSS. A fourth capacitor 64 is connected between the third node 61 and the second voltage VSS. The second switched capacitor circuit 36 includes a third switch 66, a fourth switch 68 and a fifth capacitor 70 that are connected in the same manner as the similar components of the first switched capacitor circuit 34 except that the first clock signal CLK1 is connected to the gate of the fourth switch 68 and the second clock signal CLK2 is connected to the gate of the third switch 66. Preferably, the fourth and fifth capacitors 64 and 70 are of equal value.

The first and second clock signals CLK1 and CLK2 are preferably non-overlapping clock signals. When the first clock signal CLK1 is high and the second clock signal CLK2 is low, the fourth capacitor 64 is charged to a reference voltage level (i.e., first node 32) and the fifth capacitor 70 is discharged to the second voltage VSS, and when the first clock signal CLK1 is low and the second clock signal CLK2 is high, the fourth capacitor 64 is discharged to the second voltage VSS and the fifth capacitor 70 is charged to the reference voltage level (first node 32). Thus, the reference current that flows in the third transistor 30 has an average value of:

$$IREF=2*VREF*C1*Freq \quad \text{(equation 1)}$$

where VREF is the reference voltage level at the first node 32, C1 is the capacitor value of the fourth capacitor 64, and Freq is the clock frequency. The total switched capacitor resistance is given by 1/(2*Freq*C1).

A substantially stable band-gap reference voltage is generated at the first node 32. By connecting the two switched capacitor circuits 34 and 36 in parallel, the switching current flows in both clock cycles CLK1 and CLK2 and the frequency of a ripple voltage at the first node 32 is twice the clock frequency. The ripple voltage is filtered with the second low pass filter 54, which preferably has values of R and C that result in VREF with very low ripples. That is, the second low pass filter 54 reduces voltage spikes at the second node 38. Thus, the voltage at the second node 38 can be used as a voltage reference. The first low pass filter 40 is provided to reduce the ripples in the reference current IREF and specifically has values of R and C that result in IREF with very low ripples.

Figure 2:
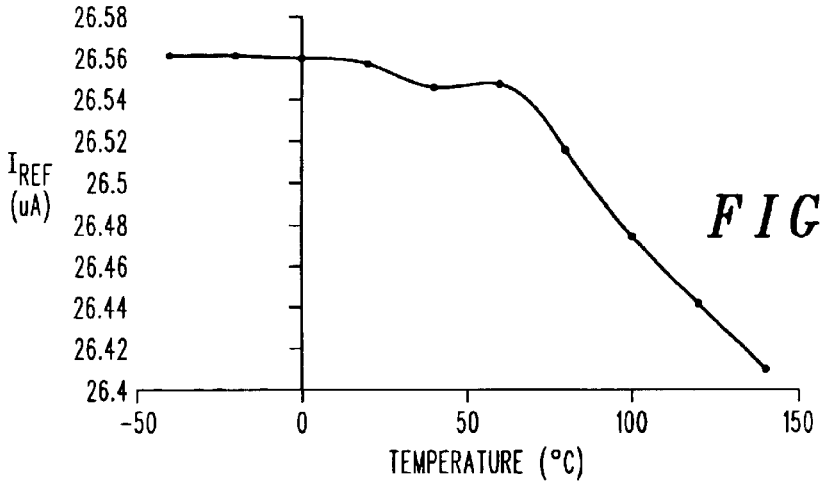
FIG. 2 is a graph of a reference current generated by the circuit of FIG. 1 versus temperature.
Figure 3:
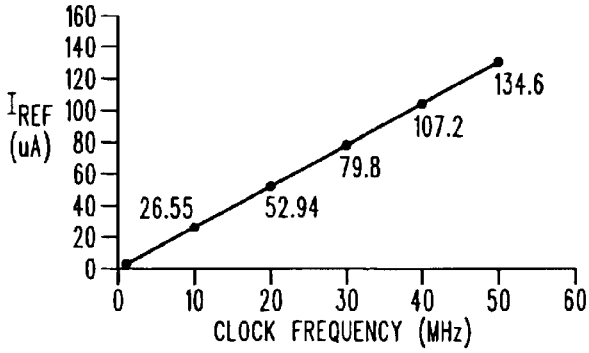
FIG. 3 is a graph of the reference current generated by the circuit of FIG. 1 versus clock frequency.

Referring now to FIGS. 2–6, graphs of various simulation results for the circuit 10 are shown. The circuit 10 was designed in BiCMOS technology having a VREF of about 1.23 v, and generated an IREF of about 26.5 uA. The fourth and fifth capacitors 64 and 70 were about 1 pF and the clock frequency was about 10 MHz. FIG. 2 is a graph of the reference current versus temperature. The generated reference current varied from a value of about 26.41 uA at 140° C. to about 26.56 uA at −40° C., which is a maximum deviation of only about 0.6%. FIG. 3 shows that the behavior of the circuit 10 with clock frequency and output current (IREF) is almost linear with a frequency sweep of 1 MHz to 50 MHz.

Figure 4:
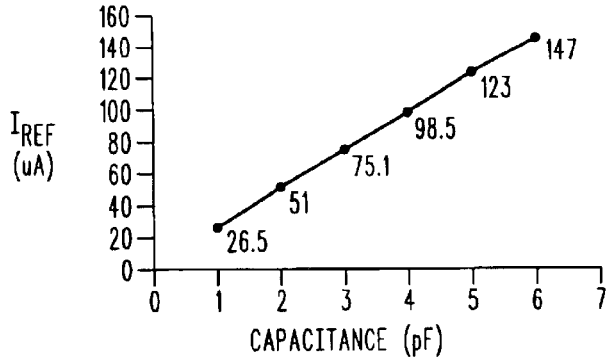
FIG. 4 is a graph of the reference current generated by the circuit of FIG. 1 versus capacitance.
Figure 5:
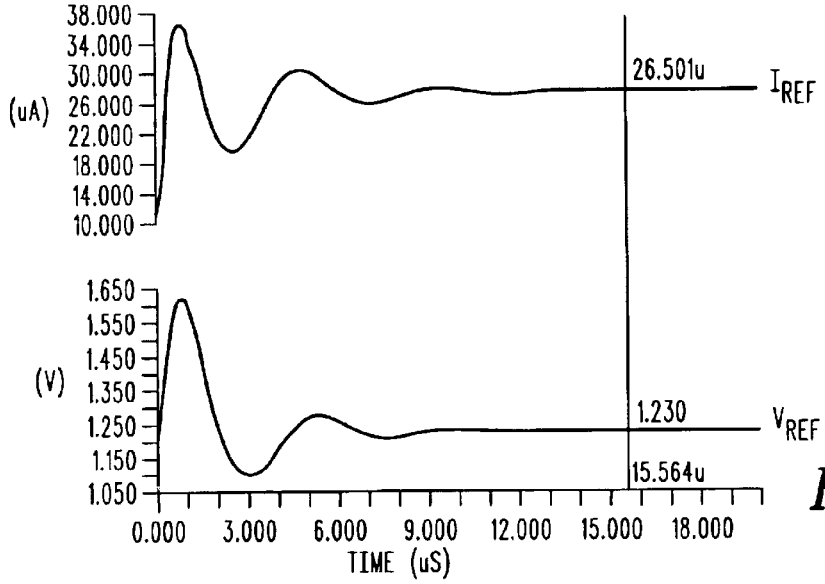
FIG. 5 is a graph showing the transient response of the circuit of FIG. 1 for both current and voltage.

FIG. 4 is a graph of the reference current (IREF) versus capacitance and shows the variation of reference current as the values of the fourth and fifth capacitors 64 and 70 change from 1 pF to 6 pF. Due to the presence of parasitic capacitance at the third and fourth nodes 61 and 67, the reference current IREF does not increase linearly with an increase in the capacitance value of the fourth and fifth capacitors 64 and 70. The total value of the capacitance at the third node 61 is the sum of the value of the fourth capacitor 64 and the parasitic capacitance. The parasitic capacitance remains substantially constant and does not scale in the same manner as that of the fourth capacitor 64. Therefore, the reference current IREF does not increase linearly with an increase in the capacitance value of the fourth and fifth capacitors 64 and 70. It may be concluded from the waveform of FIG. 4 that the reference current IREF approaches its actual value as the capacitance value of the fourth and fifth capacitors 64 and 70 is increased, which is due to the lesser effect of parasitic capacitances at higher values of the fourth and fifth capacitors 64 and 70. FIG. 5 shows the transient response of the circuit 10 for both current (IREF) and voltage (VREF), with the respective values settling after about 15.5 uS. As will be understood by those of skill in the art, the settling time depends on the R and C values of the low pass filters 40 and 54.

Figure 6:
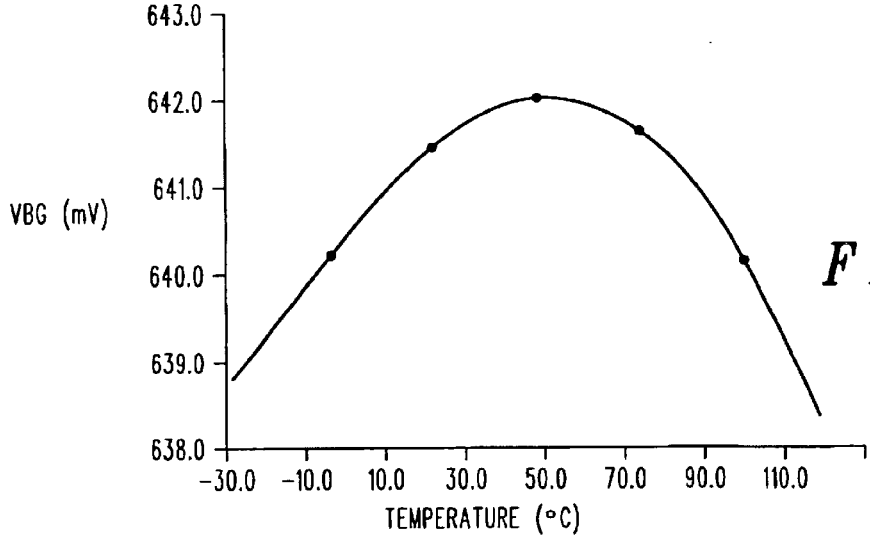
FIG. 6 is a graph of a the band-gap response of the circuit of FIG. 1.

The circuit 10 shown in FIG. 1 was designed using the Motorola HiPerMOS7 (Seventh Generation High Performance Metal Oxide Semiconductor) manufacturing process, which uses 0.13-micron lithography and SOI (Silicon on Insulator) technology along with copper interconnects. The first and second transistors 12 and 14 were formed by NMOS transistors biased in the sub-threshold region. FIG. 6 shows the band-gap voltage response of the HiPerMOS7 designed circuit. The graph shows an overall variation in the band-gap output from −30° C. to 120° C. is only about 0.5%.

Figure 7:
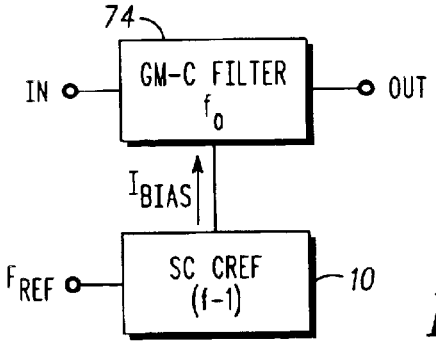
FIG. 7 is a schematic block diagram of a tunable gm-C filter including the current reference circuit of FIG. 1.

The current reference circuit 10 may be used for applications other than as a current reference. For example, since the output current (IREF) increases linearly with input clock frequency, as shown in FIG. 3, the circuit 10 can be used for frequency to current/voltage conversion. As shown in FIG. 7, the circuit 10 could also be used to supply a tunable gm-C filter 74 with a bias current $I_{BIAS}$. That is, as a circuit to control the gm of a transconductor used in a gm-C filter to provide a cutoff frequency with low dependence on PVT, preferably using the same type of capacitors in the gm-C filter 74 as used in the current reference circuit 10, described above. For a CMOS transconductor:

$$f0=gm/C=2(\beta\cdot I_{BIAS})^{1/2}/C=2(2\cdot\beta\cdot V_{REF}\cdot Ca\cdot f_{REF})^{1/2}/C$$

and for a bipolar transconductor:

$$fo=\frac{gm}{C}=\frac{Ic}{V_T.C}=\frac{2.V_{ref}.C_{ref}.f_{ref}}{V_T.C}$$

Figure 8:
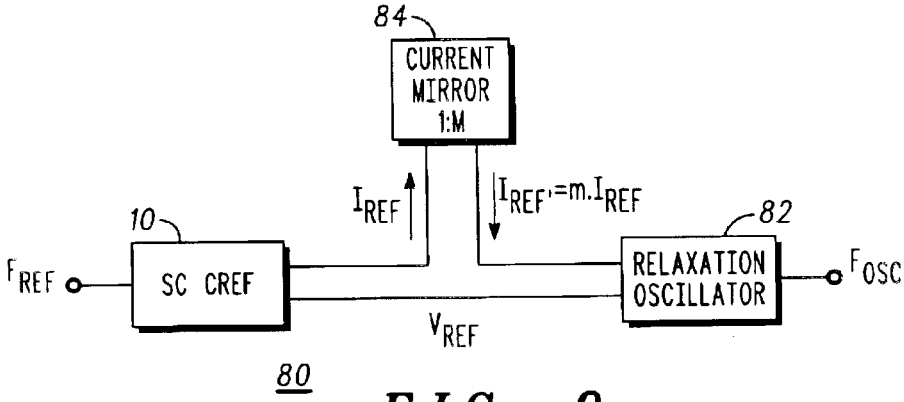
FIG. 8 is a schematic block diagram of a frequency multiplier circuit including the current reference circuit of FIG. 1.

The circuit 10 can also be used with a relaxation oscillator/current controlled oscillator to realize a multiplier/divider circuit, such as the frequency multiplier circuit 80 shown in FIG. 8. The frequency multiplier circuit 80 includes the current reference circuit 10 connected to a relaxation/current controlled oscillator 82 and a current mirror circuit 84. The frequency of the relaxation/current controlled oscillator 82 is given as:

$$Fosc=IREF'/(2*Cosc*VREF)$$

where IREF'=M*IREF, M is a multiplication factor of the current mirror circuit 84, and Cosc is a relaxation oscillator capacitor. The multiplication/division factor is controlled with M and the ratio of the fourth capacitor 64 and the relaxation oscillator capacitor Cosc. The output is substantially independent of supply, process and temperature. Preferably, the same type of capacitors are used in both the relaxation oscillator 82 and the switched capacitor current reference circuit 10.

The circuit 10 is generic in nature and can be used in any analog and mixed signal applications that require a constant voltage or current reference across PVT, like a PLL, voltage regulator, A/D, temperature sensor, oscillator, etc. Some benefits of the circuit are a small die size and low power, fully integrated, generates both reference voltage as well as current, which is almost independent of PVT, so there is no need of trimming, and can also be used as a frequency to current/voltage converter. Thus, the circuit can be used to realize a frequency multiplier/divider or a tunable gm-C filter.

Figure 9:
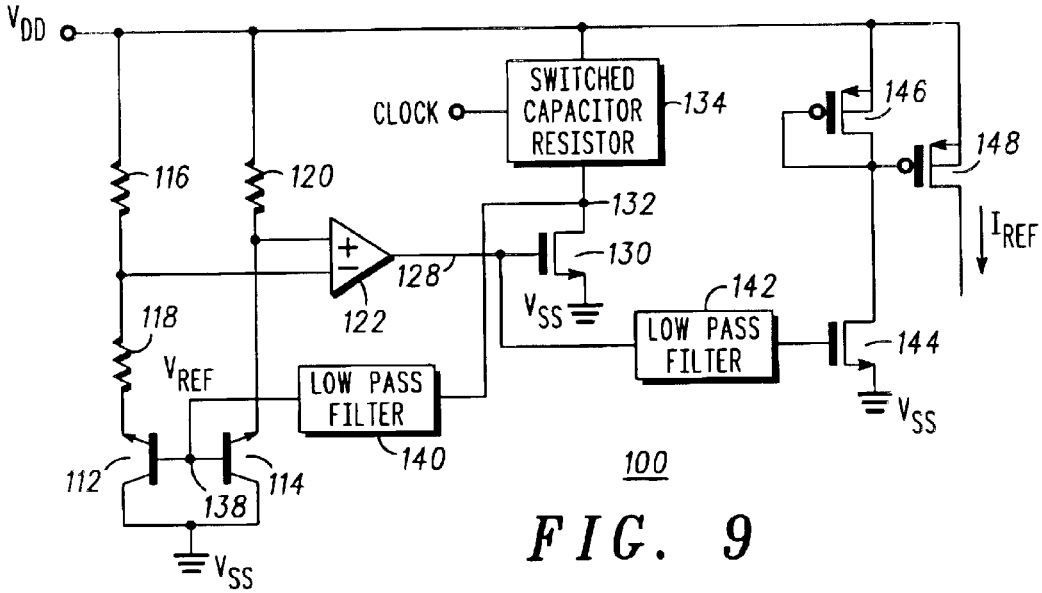
FIG. 9 is a schematic block diagram of an alternate embodiment of a current reference circuit in accordance with the present invention.

Referring now to FIG. 9, a schematic block diagram of an alternate embodiment of a current reference circuit 100 in accordance with the present invention is shown. The current reference circuit 100 differs from the current reference circuit 10 (FIG. 1) in that, although the current generated is the same, the generated reference voltage (VREF) is with reference to VDD, and not with reference to ground. More particularly, the current reference circuit 100 includes a first transistor 112 having a collector connected to a first voltage VSS and an emitter connected to a second voltage VDD by way of first and second series connected resistors 116 and 118. A second transistor 114 has a collector connected to the first voltage VSS, an emitter connected to the second voltage VDD by way of a third resistor 120, and a base connected to a base of the first transistor 112. In one embodiment, the first and second transistors 112 and 114 are bipolar transistors and in another embodiment, the first and second transistors 112 and 114 comprise sub-threshold PMOS transistors. The first voltage VSS has a ground potential and the second voltage VDD comprises a predetermined supply voltage. An op amp 122 has a positive input terminal connected to a node between the emitter of the second transistor 114 and the third resistor 120, a negative input terminal connected between the first and second resistors 116 and 118, and an output terminal 128. A third transistor 130 has a first terminal connected to the output terminal 128 of the op amp 122 and a second terminal connected to a first node 132. A switched capacitor resistor circuit 134 is connected between the first node 132 and the second voltage VDD. A feedback path connects the first node 132 to a second node 138 between the bases of the first and second transistors 112 and 114. In the embodiment shown, a first low pass filter 140 is provided between the first and second nodes 130 and 138 for reducing spikes at the second node 138. The circuit 100 also includes a second low pass filter 142 for reducing a ripple in the reference current. As will be understood by those of skill in the art, the first and second low pass filters 140 and 142 may comprise RC circuits. The circuit 100 further includes a fourth transistor 144 having a first terminal connected to the second low pass filter 142 and a second terminal connected to the first voltage VSS. A fifth transistor 146 has a first terminal connected to a second terminal thereof, which is also connected to a third terminal of the fourth transistor 144, and a third terminal connected to the second voltage VDD. A sixth transistor 148 has a first terminal connected to the first and second terminals of the fifth transistor 146 as well as the third terminal of the fourth transistor 144, a second terminal that provides a reference current IREF, and a third terminal connected to the second voltage VDD. The reference voltage VREF at the second node 138 is equal to the second voltage VDD less the band gap voltage. The switched capacitor resistor circuit 134 preferably has the same structure as the first and second switched capacitor circuits 34 and 36 shown in FIG. 1.

The description of the preferred embodiment of the present invention has been presented for purposes of illustration and description, but is not intended to be exhaustive or to limit the invention to the form disclosed. Thus, changes could be made to the embodiment described above without departing from the inventive concept thereof. It is understood, therefore, that this invention is not limited to the particular embodiment disclosed, but covers modifications within the spirit and scope of the present invention as defined by the appended claims.

What is claimed is:

1. A switched capacitor current reference circuit for generating a substantially constant reference current, comprising:

a first transistor having a collector connected to a first voltage and an emitter connected to a second voltage by way of first and second series connected resistors;

a second transistor having a collector connected to the first voltage, an emitter connected to the second voltage by way of a third resistor, and a base connected to a base of the first transistor;

an op amp having a positive input terminal connected to a node between the first and second resistors, a negative input terminal connected to a node between the emitter of the second transistor and the third resistor, and an output terminal;

a third transistor having a first terminal connected to the output terminal of the op amp and a second terminal connected to a first node;

a first switched capacitor circuit connected between the first node and the second voltage;

a second switched capacitor circuit connected between the first node and the second voltage, wherein the second switched capacitor circuit is connected in parallel with the first switched capacitor circuit; and a feedback path connecting the first node to a second node between the bases of the first and second transistors, and wherein the reference current is provided at a third terminal of the third transistor.

2. The current reference circuit of claim 1, further comprising a first low pass filter for reducing a ripple in the reference current.

3. The current reference circuit of claim 2, wherein the first low pass filter comprises:

a fourth transistor having a first terminal connected to the third terminal of the third transistor, a second terminal connected to the first voltage, and a third terminal connected to its first terminal;

a fifth transistor having a first terminal that provides the reference current, a second terminal connected to the first voltage, and a third terminal connected to the first terminal of the fourth transistor by way of a fifth resistor;

a first capacitor connected between the first voltage and the first terminal of the fourth transistor; and a second capacitor connected between the first voltage and the third terminal of the fifth transistor.

4. The current reference circuit of claim 2, further a second low pass filter for reducing spikes at the second node.

5. The current reference circuit of claim 4, wherein the second low pass filter comprises a fourth resistor connected between the first and second nodes and a capacitor connected between the second node and the second voltage.

6. The current reference circuit of claim 1, wherein the first switched capacitor circuit comprises:

a first switch having a drain connected to the first node, a source connected to a third node, and a gate connected to a first clock terminal;

a second switch having a drain connected to the third node, a source connected to the second voltage, and a gate connected to a second clock terminal; and a first capacitor connected between the third node and the second voltage.

7. The current reference circuit of claim 6, wherein the second switched capacitor circuit comprises:

a third switch having a drain connected to the first node, a source connected to a fourth node, and a gate connected to the second clock terminal;

a fourth switch having a drain connected to the fourth node, a source connected to the second voltage, and a gate connected to the first clock terminal; and a second capacitor connected between the fourth node and the second voltage.

8. The current reference circuit of claim 7, wherein a first clock signal is applied at the first clock terminal and a second clock signal is applied at the second clock terminal, the first and second clock signals are non-overlapping clock signals that drive the first and fourth, and second and third switches, respectively, and wherein when the first clock signal is high and the second clock signal is low, the first capacitor is charged to a reference voltage level and the second capacitor is discharged to the second voltage, and when the first clock signal is low and the second clock signal is high, the first capacitor is discharged to the second voltage and the second capacitor is charged to the reference voltage level.

9. The current reference circuit of claim 8, wherein the reference current that flows in the third transistor has an average value of Iref=2*Vref*C1*Fref, where Vref is the reference voltage level, C1 is the capacitor value of the first capacitor, and Fref is the clock frequency.

10. The current reference circuit of claim 1, wherein a substantially stable band-gap reference voltage is generated at the first node.

11. The current reference circuit of claim 1, wherein the first and second transistors are bipolar transistors.

12. The current reference circuit of claim 1, wherein the first and second transistors are NMOS transistors biased in a sub-threshold region thereof.

13. The current reference circuit of claim 1, wherein the first voltage comprises a predetermined supply voltage and the second voltage has a ground potential.

14. The current reference circuit of claim 1, wherein the third transistor comprises a transistor having a gate connected to the output terminal of the op amp, a drain connected to the first voltage and a source connected to the first node.

15. A switched capacitor current reference circuit for generating a substantially constant reference current, comprising:

a first transistor having a collector connected to a first voltage and an emitter connected to a second voltage by way of first and second series connected resistors;

a second transistor having a collector connected to the first voltage, an emitter connected to the second voltage by way of a third resistor, and a base connected to a base of the first transistor;

an op amp having a positive input terminal connected to a node between the first and second resistors, a negative terminal connected to a node between the emitter of the second transistor and the third resistor, and an output terminal;

a third transistor having a first terminal connected to the output terminal of the op amp and a second terminal connected to a first node;

a first switched capacitor circuit connected between the first node and the second voltage;

a second switched capacitor circuit connected between the first node and the second voltage, wherein the second switched capacitor circuit is connected in parallel with the first switched capacitor circuit;

a feedback path connecting the first node to a second node between the bases of the first and second transistors, and wherein the reference current is provided at a third terminal of the third transistor;

a first low pass filter for reducing a ripple in the reference current connected between the third transistor and the first voltage; and a second low pass filter for reducing spikes at the second node connected between the first node and the bases of the first and second transistors, wherein a substantially stable reference voltage is generated at the first node.

16. The current reference circuit of claim 15, wherein the first low pass filter comprises:

a fourth transistor having a first terminal connected to the third terminal of the third transistor, a second terminal connected to the first voltage, and a third terminal connected to its first terminal;

a fifth transistor having a first terminal that provides the reference current, a second terminal connected to the first voltage, and a third terminal connected to the first terminal of the fourth transistor by way of a fifth resistor;

a first capacitor connected between the first voltage and the first terminal of the fourth transistor; and a second capacitor connected between the first voltage and the third terminal of the fifth transistor.

17. The current reference circuit of claim 16, wherein the second low pass filter comprises a fourth resistor connected between the first and second nodes and a capacitor connected between the second node and the second voltage.

* * * * *